US005409027A

United States Patent [19]

Glunt

[11] Patent Number: 5,409,027

[45] Date of Patent: Apr. 25, 1995

[54] APPARATUSES FOR CLEANING PAINT ROLLERS THROUGH PLURAL SPRAYS WHICH TURN AND CLEAN SUPPORTED ROLLERS

[76] Inventor: Rodney L. Glunt, 2661 Johnson Dr., Chambersburg, Pa. 17201

[21] Appl. No.: 223,007

[22] Filed: Apr. 5, 1994

[51] Int. Cl.[6] ..... B08B 3/02

[52] U.S. Cl. ..... 134/138; 134/900

[58] Field of Search ..... 134/900, 138

[56] References Cited

U.S. PATENT DOCUMENTS

| | | | |
|---|---|---|---|
| 3,428,060 | 2/1969 | Spivey | 134/900 X |
| 3,587,599 | 6/1971 | Bywater | 134/900 X |
| 4,733,679 | 3/1988 | Dolcater | 134/900 X |
| 4,832,066 | 5/1989 | Shipman | 134/900 X |

*Primary Examiner*—Philip R. Coe

[57] ABSTRACT

An apparatus for cleaning paint rollers through plural sprays which turn and clean supported rollers comprising a container in a cylindrical configuration extending vertically from the bottom wall to the top. The container also includes a lid positionable over the top. The bottom wall is of a conical configuration to allow the flow of fluid from the container. The container also includes legs to support the container in its vertical orientation. A support mechanism is vertically positioned in the center of the container and is adapted to receive the interior surface of a paint roller to be cleaned. A manifold assembly includes a vertically extending first manifold and support mechanisms with radially extending apertures therethrough. A pair of exterior vertically extending manifolds are provided. They are located parallel with the first manifold and adjacent to the interior faces of the side walls to define the space between the exterior manifolds for the receipt of the roller to be cleaned. The exterior manifolds have radially extending apertures to effect the spray of water to the exterior surface of the roller to be cleaned offset from its center. A horizontal coupling manifold is connected to the lower ends of the vertical manifolds with a region thereof extending through the container for selective coupling to a hose.

3 Claims, 4 Drawing Sheets

APPARATUSES FOR CLEANING PAINT ROLLERS THROUGH PLURAL SPRAYS WHICH TURN AND CLEAN SUPPORTED ROLLERS

BACKGROUND OF THE INVENTION

1. Field of the Invention

The present invention relates to apparatuses for cleaning paint rollers through plural sprays which turn and clean supported rollers and more particularly pertains to cleaning paint rollers in a device which supports the roller to be cleaned and which applies jets of water to turn and clean the supported roller.

2. Description of the Prior Art

The use of apparatus for cleaning cylindrical objects is known in the prior art. More specifically, apparatuses for cleaning cylindrical objects heretofore devised and utilized for the purpose of cleaning cylindrical objects are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,108,189 a paint roller cleaner and dryer.

U.S. Pat. No. 4,172,373 to Lary discloses a paint roller washer.

U.S. Pat. No. 4,709,717 to Rannigan discloses a cleaning apparatus for paint rollers and the like.

U.S. Pat. No. 4,836,702 to Allen discloses a cleaning device for paint brushes and rollers.

U.S. Pat. No. 4,995,749 to Gornik discloses an apparatus for cleaning a paint roller pad.

In this respect, the apparatus for cleaning paint rollers through plural sprays which turn and clean supported rollers according to the present invention substantially departs from the conventional concepts and designs of the prior art, and in doing so provides an apparatus primarily developed for the purpose of cleaning paint rollers in a device which supports the roller to be cleaned and which applies jets of water to turn and clean the supported roller.

Therefore, it can be appreciated that there exists a continuing need for new and improved apparatus for cleaning paint rollers through plural sprays which turn and clean supported rollers which can be used for cleaning paint rollers in a device which supports the roller to be cleaned and which applies jets of water to turn and clean the supported roller. In this regard, the present invention substantially fulfills this need.

SUMMARY OF THE INVENTION

In view of the foregoing disadvantages inherent in the known types of apparatus for cleaning cylindrical objects now present in the prior art, the present invention provides an improved apparatus for cleaning paint rollers through plural sprays which turn and clean supported rollers. As such, the general purpose of the present invention, which will be described subsequently in greater detail, is to provide a new and improved apparatus for cleaning paint rollers through plural sprays which turn and clean supported rollers and method which has all the advantages of the prior art and none of the disadvantages.

To attain this, the present invention essentially comprises a new and improved apparatus for cleaning paint rollers through plural sprays which turn and clean supported rollers comprising, in combination: a container having a bottom wall, an open top and side walls in a cylindrical configuration extending vertically from the bottom wall to the top, the container also including a lid positionable over the top with clamps secured to the lid and side walls for the selective coupling thereof, the bottom wall being of a conical configuration with a coupling therebeneath to allow the flow of fluid from the container, the container also including legs to support the container in its vertical orientation about a vertical axis extending centrally through the opening and center of the side walls; a support mechanism vertically positioned in the center of the container with its axis co-extensive with the axis of the container, the support including support wires adapted to receive the interior surface of a paint roller to be cleaned; a manifold assembly including a vertically extending first manifold located at the center of the container and support with radially extending apertures therethrough, a pair of exterior vertically extending manifolds parallel with the first manifold and located adjacent to the interior faces of the side walls to define the space between the exterior manifolds for the receipt of the roller to be cleaned, the exterior manifolds having radially extending apertures offset from the radius of the container to effect the spray of water to the exterior surface of the roller to be cleaned offset from its center to thereby effect a rotation of the roller when being cleaned, a horizontal coupling manifold connected to the lower ends of the vertical manifolds with a region thereof extending through the container for selective coupling to a hose for providing clean water to the manifolds; and a valve coupled to the horizontal manifold exterior of the container for selectively initiating and terminating the flow of water whereby when the flow of water is initiated, the water will spray against the roller to be cleaned and initiate a rotating action to effect a complete cleaning of the entire roller interiorly and exteriorly.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved apparatuses for cleaning paint rollers through plural sprays which turn and clean supported rollers which have all the advantages of the prior art apparatus for cleaning cylindrical objects and none of the disadvantages.

It is another object of the present invention to provide new and improved apparatuses for cleaning paint rollers through plural sprays which turn and clean supported rollers which may be easily and efficiently manufactured and marketed.

It is further object of the present invention to provide new and improved apparatuses for cleaning paint rollers through plural sprays which turn and clean supported rollers which are of durable and reliable constructions.

An even further object of the present invention is to provide new and improved apparatuses for cleaning paint rollers through plural sprays which turn and clean supported rollers which are susceptible of a low cost of manufacture with regard to both materials and labor, and which accordingly are then susceptible of low prices of sale to the consuming public, thereby making such apparatus for cleaning paint rollers through plural sprays which turn and clean supported rollers economically available to the buying public.

Still yet another object of the present invention is to provide new and improved apparatuses for cleaning paint rollers through plural sprays which turn and clean supported rollers which provide in the apparatuses and methods of the prior art some of the advantages thereof, while simultaneously overcoming some of the disadvantages normally associated therewith.

Still another object of the present invention is to clean paint rollers in a device which supports the roller to be cleaned and which applies jets of water to turn and clean the supported roller.

Lastly, it is an object of the present invention to provide new and improved an apparatus for cleaning paint rollers through plural sprays which turn and clean supported rollers comprising: a container having a bottom wall, an open top and side walls in a cylindrical configuration extending vertically from the bottom wall to the top, the container also including a lid positionable over the top with clamps secured to the lid and side walls for the selective coupling thereof, the bottom wall being of a conical configuration with a coupling therebeneath to allow the flow of fluid from the container, the container also including legs to support the container in its vertical orientation about a vertical axis extending centrally through the opening and center of the side walls; a support mechanism vertically positioned in the center of the container with its axis co-extensive with the axis of the container adapted to receive the interior surface of a paint roller to be cleaned; a manifold assembly including a vertically extending first manifold located at the center of the container and support with radially extending apertures therethrough, a pair of exterior vertically extending manifolds parallel with the first manifold and located adjacent to the interior faces of the side walls to define the space between the exterior manifolds for the receipt of the roller to be cleaned, the exterior manifolds having radially extending apertures offset from the radius of the container to effect the spray of water to the exterior surface of the roller to be cleaned offset from its center to thereby effect a rotation of the roller when being cleaned, a horizontal coupling manifold connected to the lower ends of the vertical manifolds with a region thereof extending through the container for selective coupling to a hose for providing clean water to the manifolds.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
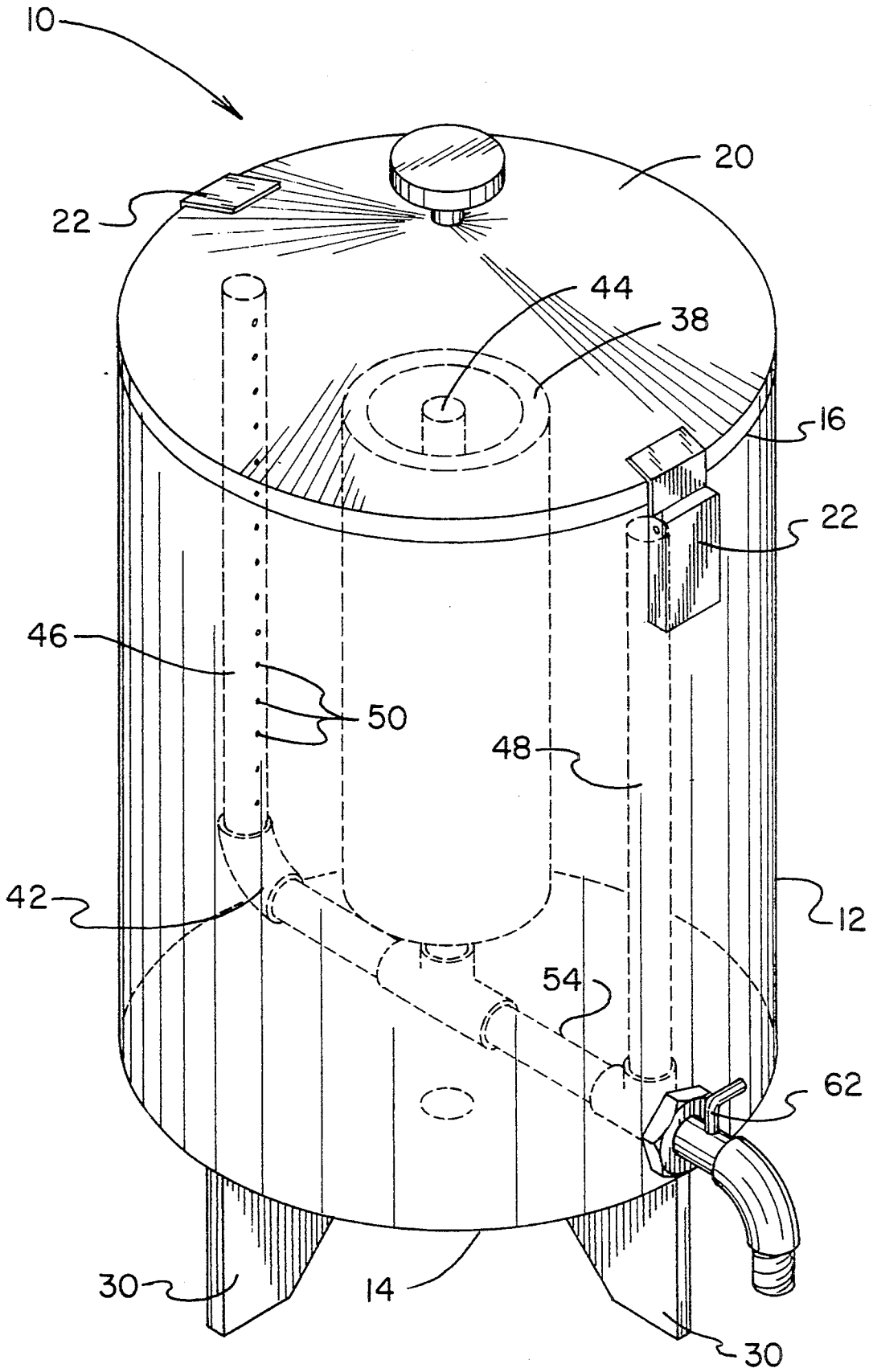
FIG. 1 is a perspective view of the preferred embodiment of the new and improved apparatus for cleaning paint rollers through plural sprays which turn and clean supported rollers constructed in accordance with the principles of the present invention.
Figure 2:
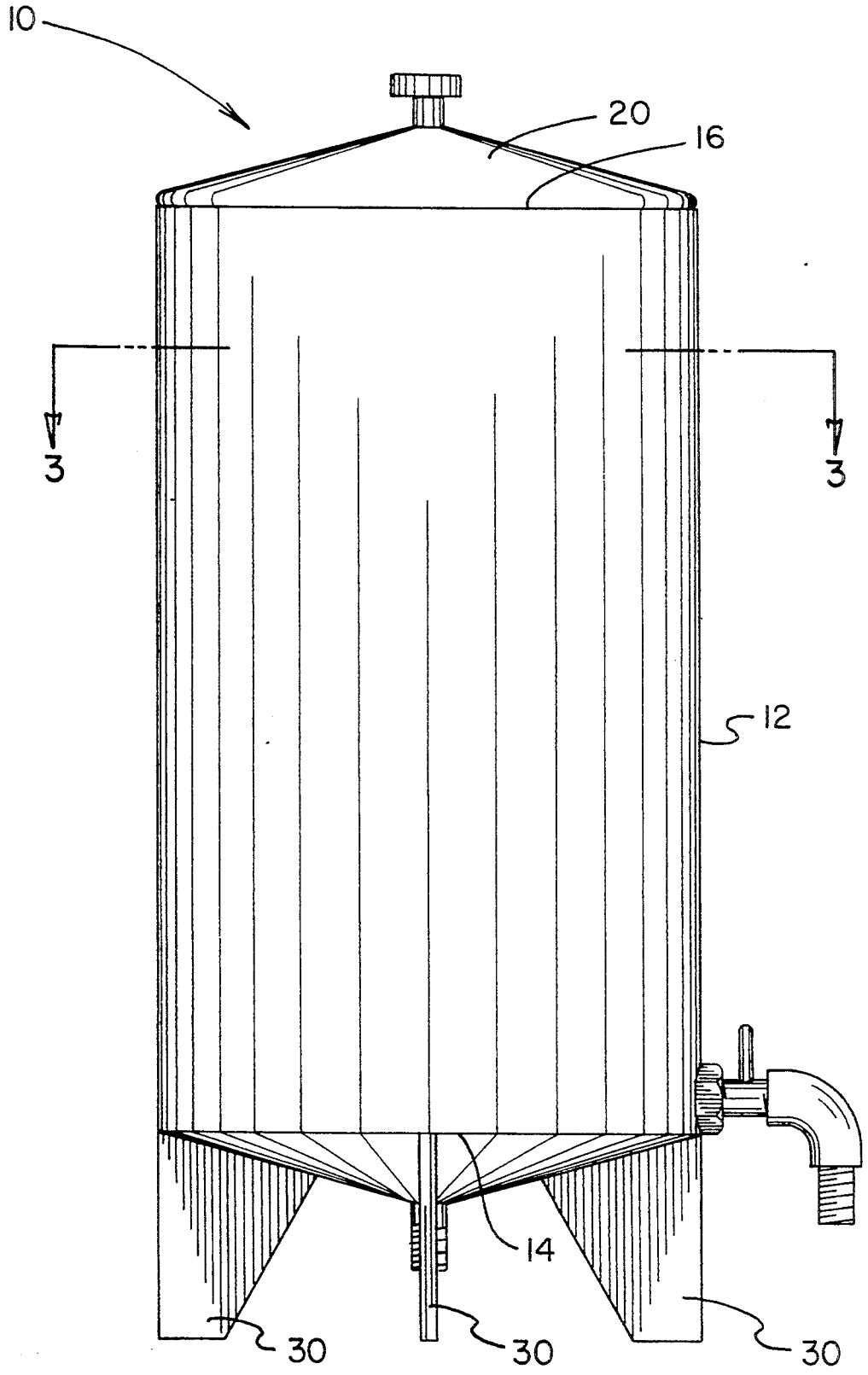
FIG. 2 is a side elevational view of the device illustrated in FIG. 1.
Figure 3:
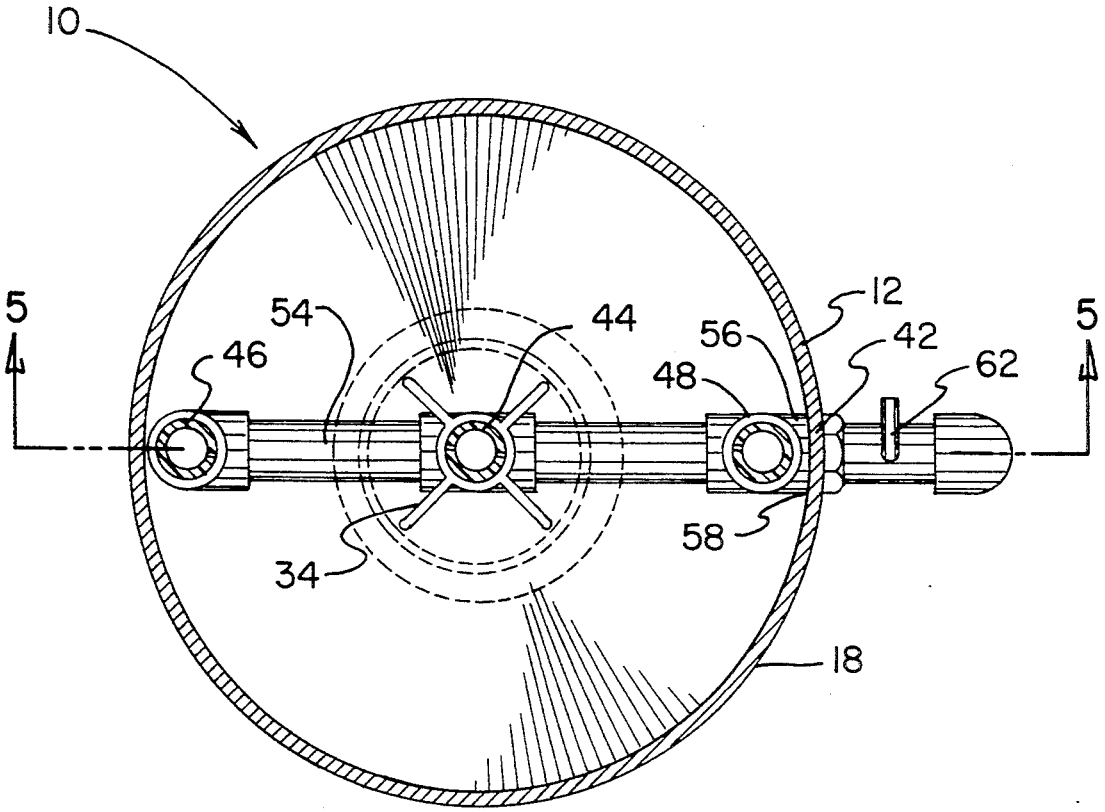
FIG. 3 is a cross-sectional view of the device of the prior Figures taken along lines 3—3 of FIG. 2.
Figure 4:
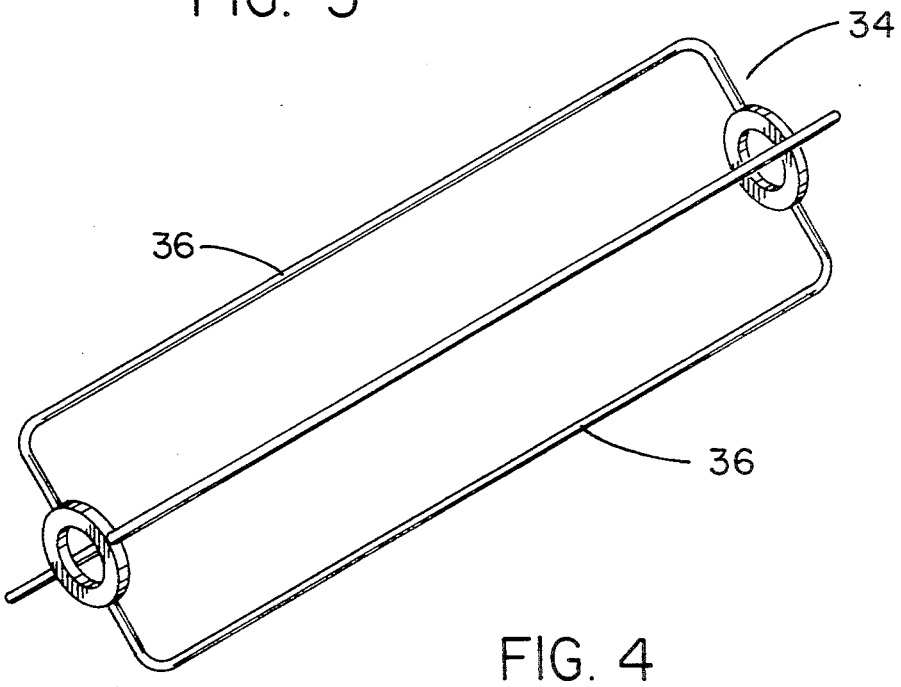
FIG. 4 is a perspective illustration of a central support for a roller to be cleaned in the apparatus of the prior Figures.
Figure 5:
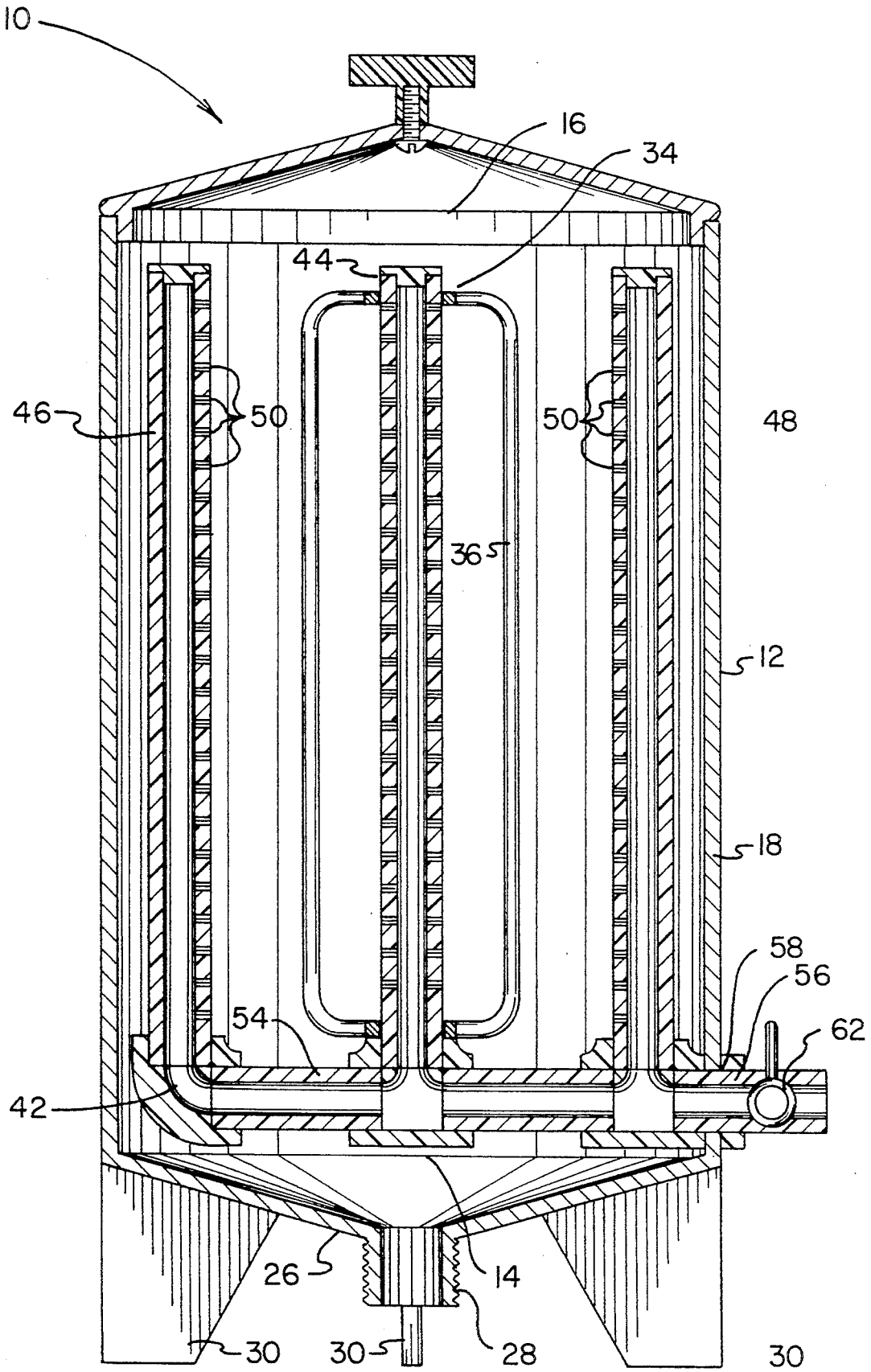
FIG. 5 is cross-sectional view of the device of the prior Figures taken along lines 5—5 of FIG. 3.

With reference now to the drawings, and in particular to FIG. 1 thereof, the preferred embodiment of the new and improved apparatus for cleaning paint rollers through plural sprays which turn and clean supported rollers embodying the principles and concepts of the present invention and generally designated by the reference numeral 10 will be described.

The present invention, the new and improved apparatus for cleaning paint rollers through plural sprays which turn and clean supported rollers, is comprised of a plurality of components. In their broadest context, such components include a container, a support mechanism, a manifold assembly and a valve. Such components are individually configured and correlated one with respect to the other so as to attain the desired objectives.

The major component of the system 10 is a container 12. The container has a circular bottom wall 14 with an open top 16 and side walls 18 in a circular configuration extending vertically upwardly from the bottom wall to the top. The container also includes a lid 20. The lid is positionable over the top of the container. It is provided with clamps 22 to secure the lid and side walls together for the selective coupling thereof during operation and use.

The bottom wall 26 of the container is preferably in a conical configuration. A coupling 28 is located therebeneath. This is to allow the flow of fluids from the container. The container also includes legs 30 to support the container in its vertical orientation. Such support is about a vertical axis extending centrally through the opening and the center of the side walls.

The next component of the system is a support mechanism 34. The support mechanism is vertically positioned in the center of the container. Its axis is coextensive with the axis of the container. The support includes supporting wires 36. The exterior surface of the wires is adapted to receive the interior surface of the paint roller 38 to be cleaned.

The functioning component of the system involves a manifold assembly 42. The manifold assembly includes a vertically extending central manifold 44. Such manifold is located at the center of the container in support. It has radially extending apertures therethrough. The manifold assembly also includes a pair of exterior vertically extending manifolds 46 and 48. Such manifolds are parallel with each and with respect to the first manifold. The exterior manifolds are located adjacent to the interior faces of the side walls. The space between the exterior manifolds defines the space for the receipt of the roller to be cleaned. The exterior manifolds have radially extending apertures 50. Such apertures are offset from the radius of the container. This is to affect a spray of water to the exterior surface of the roller to be cleaned which is offset from its center. The pressure from such water functions to thereby effect a rotation of the roller supported on the wires when being cleaned.

The manifold assembly also includes a coupling manifold 54. The coupling manifold is connected to the lower end of the vertical manifold. A central region 56 of the horizontal manifold extends through an aperture 58 in the container. This for the selective coupling of the hose to the manifold assembly for providing clean water to the manifolds during operation and use.

The last component of the system is a valve 62. The valve is coupled to the horizontal manifold exterior of the container. The valve is for selectively initiating and terminating the flow of water to the manifold interior of the container. In this manner, when the flow of water is initiated, the water will spray against the roller to be cleaned and initiate a rotating action thereof whereby a complete cleaning of the entire roller is effected externally by the exterior manifolds and internally by the first manifold.

The present device is a device for cleaning paint rollers, but without the usual mess. It looks like a large coffeepot with a twenty-to-thirty cup capacity. It is made of aluminum and PVC piping. The container is approximately one foot high and six and one-half inches in diameter. It has a cover that is secured with two catches so that it does not get pushed off during the cleaning process. The bottom is sloped so that the water will drain fast and a threaded drain pipe is installed at the bottom center. Three $\frac{1}{4}$ diameter PVC pipes are connected vertically to horizontally mounted $\frac{1}{4}$ diameter PVC pipe that protrudes outside the container. One of the vertical pipes is mounted in the center and the other two on the sides of the container, and all three have numerous holes drilled in them for the purpose of spraying the cleaning water. The holes are drilled at alternating locations on the two outside pipes to clean different portions of the paint roller. Also, these pipes are installed at a slight angle so that the roller will spin when hit by the water. The horizontal pipe is threaded with a standard hose connection thread on the outside end and has a shutoff valve installed just inside the threads.

To use the present invention, one simply mounts the paint roller over the center pipe, closes the lid tightly, hooks up the water hose to the inlet pipe, hooks up a drain hose to the drain pipe, and turns on the water. The roller is thoroughly cleaned in a few minutes with the paint residue discarded in the drain water. This present invention saves time and also enables the user to reuse paint rollers many times before discarding them.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved apparatus for cleaning paint rollers through plural sprays which turn and clean supported rollers comprising, in combination:

a container having a bottom wall, an open top and side walls in a cylindrical configuration having an axis extending vertically from the bottom wall to the top, the container also including a lid positionable over the top with clamps secured to the lid and side walls for the selective coupling thereof, the bottom wall being of a conical configuration with a coupling therebeneath to allow the flow of fluid from the container, the container also including legs to support the container in its vertical orientation about a vertical axis extending centrally through the container;

a support mechanism vertically positioned in the center of the container with its axis co-extensive with the axis of the container, the support mechanism including support wires adapted to receive the interior surface of a paint roller to be cleaned;

a manifold assembly including a vertically extending first manifold located at the center of the container and support mechanism with radially extending apertures therethrough, a pair of exterior vertically extending manifolds parallel with the first manifold and located adjacent to the interior faces of the side walls to define the space between the exterior manifolds for the receipt of the roller to be cleaned, the exterior manifolds having radially extending apertures offset from the radius of the container to effect the spray of water to the exterior surface of the roller to be cleaned offset from its center to thereby effect a rotation of the roller when being cleaned, a horizontal coupling manifold connected to the lower ends of the vertical manifolds with a region thereof extending through the container for selective coupling to a hose for providing clean water to the manifolds; and a valve coupled to the horizontal manifold exterior of the container for selectively initiating and terminating the flow of water whereby when the flow of water is initiated, the water will spray against the roller to be cleaned and initiate a rotating action to effect a complete cleaning of the entire roller interiorly and exteriorly.

2. An apparatus for cleaning paint rollers through plural sprays which turn and clean supported rollers comprising:

a container having a bottom wall, an open top and side walls in a cylindrical configuration having an axis extending vertically from the bottom wall to the top, the container also including a lid positionable over the top with clamps secured to the lid and side walls for the selective coupling thereof, the bottom wall being of a conical configuration with a coupling therebeneath to allow the flow of fluid from the container, the container also including legs to support the container in its vertical orientation about a vertical axis extending centrally through the container;

a support mechanism vertically positioned in the center of the container with its axis co-extensive with the axis of the container adapted to receive the interior surface of a paint roller to be cleaned; and a manifold assembly including a vertically extending first manifold located at the center of the container and support mechanism with radially extending apertures therethrough, a pair of exterior vertically extending manifolds parallel with the first manifold and located adjacent to the interior faces of the side walls to define the space between the exterior manifolds for the receipt of the roller to be cleaned, the exterior manifolds having radially extending apertures offset from the radius of the container to effect the spray of water to the exterior surface of the roller to be cleaned offset from its center to thereby effect a rotation of the roller when being cleaned, a horizontal coupling manifold connected to the lower ends of the vertical manifolds with a region thereof extending through the container for selective coupling to a hose for providing clean water to the manifolds.

3. The apparatus as set forth in claim 2 and further including a valve coupled to the horizontal manifold exterior of the container for selectively initiating and terminating the flow of water whereby when the flow of water is initiated, the water will spray against the roller to be cleaned and initiate a rotating action to effect a complete cleaning of the entire roller.

* * * * *